United States Patent [19]

Arni

[11] 4,428,786

[45] Jan. 31, 1984

[54] PROCESS FOR PREPARING A HIGH POWER EXPLOSIVE, HIGH POWER EXPLOSIVE PRODUCED THEREBY, AND METHOD FOR SHAPING A HIGH POWER EXPLOSIVE

[75] Inventor: Paul Arni, Hünibach, Switzerland

[73] Assignee: Schweizerische Eidgenossenschaft, Vertreten durch die Eidg. Munitionsfabrik Thun der Gruppe für Rüstungsdienste, Thun, Switzerland

[21] Appl. No.: 376,916

[22] Filed: May 10, 1982

[30] Foreign Application Priority Data

May 25, 1981 [CH] Switzerland ..... 3403/81
Mar. 9, 1982 [CH] Switzerland ..... 1423/82

[51] Int. Cl.[3] ..... C06B 45/02; C06B 21/00

[52] U.S. Cl. ..... 149/21; 149/2; 149/92; 149/109.6; 149/110; 149/114; 149/115; 264/3 R

[58] Field of Search ..... 149/2, 92, 21, 109.6, 149/110, 114, 115; 264/3 R

[56] References Cited

U.S. PATENT DOCUMENTS

| | | | |
|---|---|---|---|
| 2,597,926 | 5/1952 | Ehrlich . | |
| 4,090,894 | 5/1978 | Reed et al. | 149/92 |
| 4,239,073 | 12/1980 | Reed et al. | 149/92 |
| 4,283,237 | 8/1981 | Reed et al. | 149/92 |
| 4,357,185 | 11/1982 | Ringbloom | 149/92 |

OTHER PUBLICATIONS

Chemical Abstracts, vol. 90, p. 121, 74067j, 1979; Chugoku Kayaku Co. Ltd.

*Primary Examiner*—Stephen J. Lechert, Jr.
*Assistant Examiner*—Joel P. Okamoto
*Attorney, Agent, or Firm*—Werner W. Kleeman

[57] ABSTRACT

A plastic bound high power explosive comprises 90 to 97 percent by weight of a powerful explosive compound, for example octogen, and 3 to 10 percent by weight of a novel stabilizing and binding agent. The agent comprises substantially 20 to 50 percent poly-O-butyl acrylate and 3.5 to 20 percent paraffin, as well as 2 to 7 percent poly tetrafluorethylene as a lubricant, 20 to 65 percent of a filler and 1 to 8 percent poly ethylene or, respectively, in the case of an antistatic high power explosive, 25 to 65 percent graphite as a lubricant and 15 to 25 percent calcium sulphate as a filler, each by weight of the portion of solids in the agent. Further additives like emulsifiers, dispersants, defoamers, surfactants, thickeners and small amounts of silica gel are added. The stabilizing and binding agent is prepared as an aqueous dispersion which is mixed with the dry explosive compound in a mixing drum, then dried or, respectively, predried and treated with an isopropanol-water mixture (1:1) prior to being finally dried. Homogeneous bodies cold-pressed therefrom using a die at pressures in the range of about 1.5 to 4.2 kbar/cm$^2$ have densities above 1.8 g/cm$^3$ and their detonation velocities exceed 8.6 km/s.

55 Claims, No Drawings

PROCESS FOR PREPARING A HIGH POWER EXPLOSIVE, HIGH POWER EXPLOSIVE PRODUCED THEREBY, AND METHOD FOR SHAPING A HIGH POWER EXPLOSIVE

BACKGROUND OF THE INVENTION

The invention relates to a process of preparing a high power explosive from a powerful explosive compound like cyclotetramethylenetetranitramine or cyclotrimethylenetrinitramine.

The invention also relates to a plastic bound high power explosive including at least 90 percent by weight of a powerful explosive like cyclotetramethylenetetranitramine or cyclotrimethylenetrinitramine and a maximum of 10 percent by weight of a stabilizing and binding agent comprising an organic polymer and additives.

Furthermore, the invention relates to a method for shaping the high power explosive by die-comprising the same. According to a known process of the initially mentioned kind, see U.S. Pat. No. 3,839,106 issued to Felix Louis Joseph Dubois de Prisque et al. on Oct. 1, 1974, a high power explosive is obtained by dispersing a powerful explosive compound like octogen (trivial name of cyclotetramethylenetetranitramine which will be used throughout the following) in a rubber-like two-component binder comprising a prepolymer having two preferably terminal carboxyl groups and an epoxide based crosslinking agent. Further a stabilizer like wax is added as well as other additives like catalysts for crosslinking the stabilizing and binding agent, antioxidants and surfactants. In detail, at first the binder components are mixed using a kneader at increased temperatures under vacuum; then the stabilizing and binding agent is blended with the octogen under the same conditions. Thereby a castable mass is obtained which is cast under the action of vibrations in molds wherein the mass hardens within a couple of days. Thus high power explosive shaped bodies are formed without the application of pressure and may contain up to 90 percent octagon by weight of the total.

A similar process (French Patent Office Publication No. 2.225.979) employs a two-component binder comprising di-isocyanates and polyols; however, in the high power explosive shaped bodies thus obtained the proportional amounts of octogen are below 90 percent by weight of the total.

The known process is somewhat involved in that the stabilizing and binding agent as such and the octogen are required to be blended in a kneader under vacuum at increased temperatures and in that the subsequent casting process will have to be conducted under vacuum, too. Throughout thereof vibrations must be applied to achieve the desired homogeneity. Additionally, the entire process becomes time consuming due to a hardening period of several days. The high power explosive shaped body finally obtained thereby still contains 10 percent by weight or more of foreign matter so that its explosive strength is considerably decreased as compared to that of pure octogen.

It is known to combine hexogen (cyclotrimethylenetrinitramine) and poly tetrafluoroethylene in aqueous dispersion; the warm-dried combination product comprises 97 percent hexogen and 3 percent poly tetrafluoroethylene by weight of the total and becomes plastically deformed already under low pressures, see German Auslegeschrift 1,571,227 issued to Imperial Chemical Industries Ltd. of London, U.K. The effect of the poly tetrafluoroethylene is said to result from the low friction between the explosive particles coated therewith. However, due to the low friction between the particles of the explosive, the bodies shaped therefrom do not have sufficient dimensional stability.

It is further known from German Offenlegungsschrift 14 46 875 issued to Dynamit Nobel AG that graphite or talc may be used as a lubricant for pentaerythritol tetranitrate in proportional amounts of 0.3 to 5 percent, the mixture being prepared in aqueous dispersion. To eliminate the formation of electrostatic charges on for example octogen use of special carbon blacks is recommended which have a specific resistance of below 1 Ohm cm and a specific surface area above 20 $m^2$ per g and which may be applied to the surface of the explosive particles in proportional amounts of up to 0.5 percent.

SUMMARY OF THE INVENTION

It is one object to be achieved by the invention to provide for a high power explosive of the initially mentioned kind the explosive strength and efficiency of which approximates that of pure octogen as closely as possible.

It is a further object to be achieved by the invention to provide for a high power explosive of the initially mentioned kind which has very much the explosive strength of pure octogen and which can be shaped to bodies of high mechanical strength.

It is another object to be achieved by the invention to provide for a high power explosive of the initially mentioned kind which has very much the explosive strength of pure octogen but which is of high handling safety.

It is also an object to be achieved by the invention to provide for a high power explosive of the initially mentioned kind which has very much the explosive strength of pure octogen and which can be die-pressed to various stable shapes at ambient temperatures.

It is a final object to be achieved by the invention to provide for a process of the initially mentioned kind in which a high power explosive having very much the explosive strength of pure octogen is obtained with very simple means in fairly short times and which process is safe and reliable to conduct.

The safety aspect of the invention and in particular the handling safety of the respective high power explosives relate to the relative safety in preparing and further treating the same, to the relative insensitivity to exterior effects of any kind in use and to the stability with respect to shape (for example under impact loads on firing) and to mechanical strength of the shaped bodies from the high power explosive.

In the process according to the invention said objects are achieved by preparing an aqueous dispersion of a stabilizing and binding agent by mixing an aqueous polymer dispersion with a lubricant, with an aqueous paraffin dispersion and with a filler in the presence of usual additives, blending said aqueous dispersion of said stabilizing and binding agent with a dry powerful explosive compound like cyclotetramethylenetetranitramine or cyclotrimethylenetrinitramine and warm-drying the blend thus obtained to yield a high power explosive comprising at least 90 percent by weight of said powerful explosive compound and a maximum of 10 percent by weight of said stabilizing and binding agent.

The process according to the invention employs aqueous dispersions of the polymer and of the other components of the stabilizing and binding agent so that a thorough mixture thereof and with further related components is obtained using simple means at room temperature under atmospheric pressure in the shortest of times. The usual additives are additives conventionally used to assist in the preparation of aqueous dispersions of material insoluble in water and comprise for example emulsifiers, dispersants, surfactants, defoamers and thickeners. Subsequently the aqueous dispersion of the stabilizing and binding agent is combined effectively with the octogen in a mixing drum, also at room temperature and under atmospheric pressure in a very short time. The product thus obtained is dried in a current of warm air, also is a very simple manner. Despite of a high content of octogen (up to 97 percent by weight of the total) the dried product is safe to handle to a high degree.

The fillers added are alkaline earth compounds of low solubility which may be selected from the group magnesium pyrophosphate, calcium carbonate, calcium sulphate, barium sulphate.

In one way of carrying out the process according to the invention the aqueous polymer dispersion is prepared by mixing an aqueous dispersion of poly-O-butyl acrylate (poly-acrylic acid butyl ester) with an aqueous dispersion of poly ethylene, about 5 to about 15 percent by weight of the poly-O-butyl acrylate being added of the latter which should have an average particle size of about 0.1 to about 0.3 μm. Poly tetrafluoroethylene forming the lubricant, highly dispersed silica gel, paraffin and calcium carbonate forming the filler and having a particle size of approximately 1 μm are added consecutively.

In a second way of conducting the process according to the invention in which an antistatic high power explosive is obtained, the aqueous polymer dispersion is prepared from a poly-O-alkyl acrylate or poly-O-alkyl methacrylate (poly methacrylic acid alkyl ester) with an alkyl group of at least three carbon atoms, preferably poly-O-butyl or poly-O-isobutyl acrylate. A first component comprising a portion of the polymer, graphite as a lubricant and a portion of the paraffin is mixed with a second component comprising calcium sulfate as a filler, microdispersed silica gel and the remaining portion of the paraffin; the mixture, then, is mixed with a third component comprising cyclohexanone and the remaining portion of the polymer in an alkanol-water, preferably isopropanol-water mixture to form the aqueous dispersion of the stabilizing and binding agent.

It has been found in practice on carrying out the second variant of the process according to the invention that independent of the particle size of the octogen used a completely homogeneous distribution of the stabilizing and binding agent over the octogen particles is achieved by predrying and turning over the blend of octogen and of the stabilizing and binding agent, subsequently treating the same with addition of about 2 to about 10 percent isopropanol-water preferably (1 to 1 mixture) by weight of the blend and drying the product while turning over the same in a current of warm air.

The plastic bound high power explosive according to the invention comprises a stabilizing and binding agent including a polymer on a poly acrylate or poly methacrylate basis, a lubricant and a filler.

The filler in the stabilizing and binding agent of the plastic bound high power explosive according to the invention is selected from alkaline earth compounds of low solubility and may be selected from the group magnesium pyrophosphate, calcium carbonate, calcium sulphate, or barium sulphate.

The polymer therein may be a poly-O-alkyl acrylate or poly-O-alkyl methacrylate, preferably poly-O-butyl or poly-O-isobutyl acrylate, and the high power explosive includes a stabilizing and binding agent substantially comprising about 20 to about 50 percent by weight of poly-O-butyl acrylate, about 2 to about 8 percent by weight of poly ethylene, about 2 to about 7 percent by weight of poly tetrafluoroethylene, about 20 to about 65 percent by weight of calcium carbonate, about 0.3 to about 1.5 percent by weight of silica gel and about 8 to about 20 percent by weight of paraffin.

An antistatic variant of the high power explosive according to the invention includes a stabilizing and binding agent substantially comprising about 18 to about 40 percent by weight of poly-O-butyl acrylate, about 25 to about 65 percent by weight of graphite having a mean particle size of 2.5 μm and a particle size distribution corresponding to 95 percent below 5 μm, about 15 to about 25 percent by weight of calcium sulphate, about 0.7 to about 2.3 percent by weight of silica gel and about 7 to about 17 percent by weight of paraffin.

With respect to the method of shaping the high power explosive according to the invention the high power explosive is filled into a mold and compressed using a die at pressures in excess of 1.5 kbar at ambient temperature. The high power explosive prepared in accordance with the invention thus is processed by cold-pressing to shaped bodies like for example shaped charges for High Explosive Anti Tank (HEAT) Warheads). Hitherto such particularly simple processing methods could not be applied successfully to explosives including high proportional amounts of octogen.

It has become known (German Offenlegungsschrift No. 24 34 252 issued to Dynamit Nobel AG, Troisdorf, Federal Republic of Germany) that die-formed bodies can be obtained at pressures of about 1.2 kbar from hexogen containing 5 percent by weight of wax.

The shaped bodies prepared according to the invention have densities of about 1.8 g per $cm^3$ and detonation velocities above 8.6 km per sec. Such bodies have increased mechanical strength and homogeneity and are insensitive to shock and to friction within wider limite than expected; they are, also, thermally stable and to a significant extent pressure proof and safe in bullet impact tests.

It is of essential significance for the composition of the stabilizing and binding agent that the poly-O-butyl acrylate increases the adhesion between the particles of the explosive sufficiently for further processing and for the dimensional stability of the shaped body ultimately formed therefrom. The same is true for the poly ethylene which additionally supports the stabilizing effect caused by the paraffin which is provided instead of wax. Both polymers have not become know hitherto as binding agents for octogen. Poly tetrafluoroethylene which as such is known as a lubricant is present in a proportion adapted to the aforementioned components which is selected just so as to not impair the dimensional stability of the shaped bodies ultimately produced, but so as to enable the shaped bodies to be removed smoothly and undamaged from the mold after shaping.

Graphite, particularly graphite having an average particle size of about 2.5 μm and a particle size distribution of 95 percent below 5 μm, supports the stabilizing action of the paraffin and prevents the explosive particles from becoming charged electrostatically. The graphite also acts as a lubricant and the amount thereof is selected such that the dimensional stability of the shaped bodies ultimately produced is only negligibly impaired while the shaped bodies can be removed smoothly and undamaged from the mold after shaping.

It has been found unexpectedly in practice that particularly dimensionally stable shaped bodies of relatively low impact-sensitivity may be obtained using octogen with a particle size of less than 1.68 mm, preferably less than 0.5 mm.

The filler which forms an alkaline earth compound having low solubility is firstly added to increase pourability of the particles of the high power explosive and to decrease their mutual adherence due to the binding agent coating. Surprisingly, it has been found that such fillers, contrary to other white pigments, have a significant stabilizing effect and together with the aforementioned polymers enables high power explosives containing octogen in proportional amounts exceeding 90 percent by weight to be handled safely. Unexpectedly, moreover, the mechanical strength of the shaped bodies produced from the high power explosive is augmented, also, by the addition of the filler.

DESCRIPTION OF THE PREFERRED EMBODIMENTS

The plastic bound high power explosive containing poly tetrafluoroethylene as a lubricant includes about 3 to about 10 percent by weight of a stabilizing and binding agent composed of poly-O-butyl acrylate in the range of about 20 to about 50 percent by weight, poly ethylene in the range of about 2 to about 8 percent by weight, poly tetrafluoroethylene in the range of about 2 to about 7 percent by weight, filler up to about 65 percent by weight, at least 0.1 percent by weight of silica gel, paraffin in the range of about 8 to about 20 percent by weight, and usual additives like emulsifiers, dispersants, surfactants, defoamers and thickeners. The filler consists of an alkaline earth compound having low solubility, preferably magnesium pyrophosphate, calcium carbonate, calcium sulphate or barium sulphate. Magnesium pyrophosphate is precipitated from aqueous solution by combining stoichiometric amounts of sodium pyrophosphate and magnesium sulphate, filtered and dried; the others are commercial products. A preferred embodiment comprising 4 percent by weight of the stabilizing and binding agent is obtained as follows:

1. Preparation of 100 kg dispersion of the stabilizing and binding agent

1a. Preparation of the aqueous polymer dispersion 39 kg of a commercially available aqueous dispersion of poly-O-butyl acrylate (containing 24 percent by weight, i.e. 9.3 kg of poly-O-butyl acrylate) are diluted with 8 l of water with stirring; firstly, 0.7 kg of a defoamer on silicone basis (containing 10 percent by weight, i.e. 0.07 kg) and 0.3 kg of a surfactant on an alkanol polyglycolether basis are added. The mixture is stirred until homogeneous; then, 3.4 kg of a commercially available aqueous dispersion of poly ethylene (containing 35 percent by weight, i.e. 1.2 kg poly ethylene) are added with further stirring.

1b. Addition of the further components

At sufficiently low stirring speed (to prevent flocculation) 2.4 kg of a commercially available aqueous dispersion of poly tetrafluoroethylene (containing 60 percent by weight, i.e. 1.44 kg poly tetrafluoroethylene; particle size 0.05 to 0.5 μm) are added. Subsequently 0.5 kg of commercially available colloidal silica gel (average particle size 12 nm) are added in portions at low stirring speed until the latter is completely wetted and then at high stirring speed until eventually formed lumps are dispersed completely.

After admixture of the silica gel 15 kg of an aqueous paraffin dispersion (see hereinbelow; 30 percent by weight, i.e. 3.6 kg paraffin (commercially available, m.p. about 52° C.) and 6 percent by weight, i.e. 0.9 kg of a commercially available emulsifier on alkyl polyglycolether basis) are added with heavy stirring but avoiding foam formation.

To the mixture thus obtained 25 kg calcium carbonate (particle size 1 μm; in accordance with the prescription as set forth in the Austrian or Belgian pharmacopoeia OEAB 9 or Ph.Belg.V, respectively) are added; the stirring speed is low at first and then gradually increased with decreasing viscosity of the incipiently pulpy mass until a fluid mixture is obtained.

Finally, 1.1 kg of commercially available sodium carboxymethyl callulose and 4.5 l of distilled water are added to the dispersion which is stirred further until completely homogeneous. The whole mixture is then passed through a three-roller mill whereby the viscosity and foam formation are favourably affected. Thereafter the dispersion of the stabilizing and binding agent is ready for use after another 24 hrs. of maturing.

1c. Preparation of the aqueous paraffin dispersion 6 kg paraffin are melted with the addition of 1.5 kg of the aforementioned emulsifier; the melt is well mixed and heated to 95° C. The paraffin mixture heated to 95° C. is added in batches with stirring to 17.5 kg distilled water of 85° C. Stirring is continued until a homogeneous dispersion is formed which is left with stirring to cool to below 40° C. After another day of maturing the aqueous paraffin dispersion is ready for use.

2. Preparation of the high power explosive

To 10 kg of dry octogen 1 kg of the aqueous dispersion of the stabilizing and binding agent obtained as hereinbefore is added. The resulting mass is firstly turned over manually and then blended in a conventional mixing drum for 10 minutes. The mixture is removed from the mixing drum, spread out in a thin layer and dried by a current of warm air with occasionally turning over.

3a. Preparation of shaped bodies from the high power explosive

The high power explosive as obtained sub. 2 is cold-pressed using a conventional mold and die and applying a pressure in the range of about 1.5 to about 4 kbar. The best results, particularly with a view to safety and power were obtained at a pressure of about 3.5 kbar.

3b. Properties of the Shaped Bodies Formed From the High Power Explosive

The shaped bodies have densities of 1.81 g per $cm^3$ and above. The detonation velocity is 8.6 km per sec.

The impact sensitivity has been examined using the drop hammer test according to Koenen and Ide. Using a drop hammer of 2 kg and 10 $mm^3$ samples, only in a small number of cases weak reactions have been observed at drop heights of 25 cm, while reactions were observed in 30 and 50 percent of the cases at drop heights of 30 and 35 cm, respectively. Using a drop hammer of 5 kg and 40 $mm^3$ samples, no reactions were observed at drop heights of 30 cm, reactions were observed only in a small number of cases at drop heights of 35 cm and in 0 to 20 percent of the cases at drop heights of 40 cm.

Friction sensitivity was tested in a Peters device; no reactions were observed at friction peg loads of 12 kg, but in a small number of cases a scorching reaction occurred at 14 to 16 kg loads.

The compression strength has been measured for equal-sided (having equal height and diameter) cylindrical bodies of 20, 40 and 60 $mm^3$ die-pressed from the explosive; at values above 100 kg per $cm^2$ the compression strength is twice that found for shaped bodies die-pressed from conventional explosives.

The antistatic plastic bound high power explosive containing graphite as a lubricant includes about 3 to about 10 percent by weight of a stabilizing and binding agent composed of poly-O-butyl acrylate in the range of about 18 to about 40 percent by weight, graphite in the range of about 25 to about 65 percent by weight, filler in the range of about 12 to about 25 percent by weight, at least 0.1 percent by weight of silica gel, paraffin in the range of about 7 to about 17 percent by weight and usual additives like emulsifiers, dispersants, surfactants, defoamers and thickeners. The filler consists of an alkaline earth compound having low solubility, preferably magnesium pyrophosphate, calcium carbonate, calcium sulphate or barium sulphate. Magnesium pyrophosphate is precipitated from aqueous solution by combining stoichiometric amounts of sodium pyrophosphate and magnesium sulphate, filtered and dried; the others are commercial products. A preferred embodiment comprising 4.3 percent by weight of the stabilizing and binding agent is obtained as follows:

4. Preparation of 100 kg dispersion of the stabilizing and binding agent

4a. Preparation of a first component of the stabilizing and binding agent dispersion 24 kg of water, 0.5 kg of a defoamer on silicone basis (containing 10 percent by weight, i.e. 0.05 kg) and 15 kg of a commercially available aqueous dispersion of poly-O-butyl acrylate (containing 24 percent by weight, i.e. 3.6 kg poly-O-butyl acrylate) are consecutively mixed with vigorous stirring until the mixture is homogeneous. Then, 12.5 kg of graphite (K 2.5; Lonza), 2 kg of an aqueous paraffin dispersion (see hereinbelow) and finally 0.3 kg of commercially available sodium carboxy methyl cellulose are added one after the other under the additional action of ultrasound (using a known immersion-type ultrasound generator) under otherwisely the same conditions. About 1 hr. after the lastmentioned component has been added a homogeneous dispersion is obtained.

4b. Preparation of a second component of the stabilizing and binding agent dispersion In 16.7 kg of water 0.05 kg of a surfactant on alkanol polyglycolether basis, 0.2 kg of a dispersant, for example on poly alkylene glycolether basis, and 0.1 kg of the defoamer mentioned sub 4a. are dispersed one after the other with vigorous stirring and under the action of the immersion-type ultrasound generator. Subsequently the following ingredients are dispersed in the dispersion thus obtained consecutively under the same conditions: 5 kg of calcium sulphate (precipitated calcium sulphate purum or pro analysi; Fluka AG), 0.4 kg of commercially available colloidal silica gel (average particle size 12 nm), 13.35 kg of the aqueous paraffin dispersion mentioned sub 4a. (see hereinbelow) and finally 0.4 kg of the commercially available sodium carboxymethyl cellulose. About 1 hr. after the lastmentioned component has been added a homogeneous dispersion is obtained.

4c. Preparation of the actual stabilizing and binding agent dispersion

The components as obtained sub 4a. and 4b. are combined, heated to about 35° C. and blended. Due to the high viscosity of the product the blending operation may be performed in a kneader. 0.4 kg of the commercially available sodium carboxymethyl cellulose are, then, homogeneously dispersed with vigorous stirring in the dispersion thus obtained which takes about an hour.

Thereafter, 0.6 kg of cyclohexanone and 8.3 kg of a commercially available dispersion of poly-O-butyl acrylate (containing 40 percent by weight, i.e. 3.3 kg poly-O-butyl acrylate) in isopropanol-water (mixing ratio 2 to 1) are added consecutively to the dispersion just obtained with vigorous stirring. The stirring operation is terminated after 3 hrs. and repeated for 1 hr. one day later. The stabilizing and binding agent dispersion, then, is ready for use but requires stirring before actual use.

4d. Preparation of the aqueous paraffin dispersion 3.7 kg paraffin are melted with the addition of 0.9 kg of the aforementioned emulsifier; the melt is well mixed and heated to 95° C. The paraffin mixture heated to 95° C. is added in batches with stirring to 10.75 kg distilled water of 85° C. Stirring is continued until a homogeneous dispersion is formed which is left with stirring to cool to below 40° C. After another day of maturing the aqueous paraffin dispersion is ready for use.

5. Preparation of the high power explosive 7 kg dry octogen are added to 1.015 kg of the aqueous stabilizing and binding agent dispersion and the latter is evenly distributed over the explosive compound. The resulting mass, then, is turned over in a mixing drum of conventional design and the stabilizing and binding agent is thereby homogeneously distributed over the explosive compound after 10 minutes. The mixture is removed from the mixing drum, spread out in a thin layer and predried by a current of warm air with occasional turning over.

290 g of isopropanol-water (mixing ratio 1 to 1) corresponding to about 4 percent by weight are added to the predried material in a rotating drum and the mixture is turned over for 15 to 30 minutes. Subsequently the mixture is removed from the mixing drum, spread out in a thin layer and completely dried by a current of warm air with occasional turning over.

The lastmentioned operations may be carried out eventually in a fluidized bed process provided that the appropriate safety measures are observed.

6a. Preparation of shaped bodies from the high power explosive

The high power explosive as obtained sub 5. is cold-pressed using a conventional mold and die and applying a pressure in the range of about 1.5 to about 4.2 kbar. Normally, pressures in the range of about 2.2 to about 3.5 kbar will be sufficient, however, in case of specific requirements, also in the case of shaped charges and high power charges, the applied pressures may be higher.

6b. Properties of the shaped bodies formed from the high power explosive

The shaped bodies have densities above 1.80 g per $cm^3$. Measured detonation velocities were in the range of 8.6 km per sec and higher.

The impact sensitivity has been examined using the drop hammer test according to Koenen and Ide. According thereto, particularly favourable results were obtained for particle sizes of the explosive compound below 0.5 mm: Using a drop hammer of 2 kg and an explosive volume of 10 $mm^3$ and using a drop hammer of 5 kg and an explosive volume of 40 $mm^3$ no reactions were observed at drop heights of 40 and 60 cm, respectively.

The compression strength has been measured for equal-sided cylindrical pressed bodies of explosive (pressing power in the range of 1.9 to 4.2 kbar per $cm^2$) at room temperature. The values obtained for the compression strength increased with decreasing particle size and increasing pressing power and may be twice those found for known wax-containing shaped bodies formed from octogen. A further increase by up to 30 percent occurs in the compression strength when the shaped bodies are left to age (1 to 2 weeks at room temperature or 3 to 4 days at +50° C.).

After all, explosives having the desired high densities are obtained in accordance with the methods described hereinbefore using even fine-grained material and applying manageable pressing powers, the explosives having the additional advantages of increased strength and reduced impact sensitivity. Therefore, such explosives are particularly safe to handle whereto their surface conductivity contributes significantly (at a measuring voltage of 6 volts the surface resistance according to standard measurement procedures (DIN 53482) is several kOhms).

What is claimed is:

1. A process for preparing a high power explosive, said process comprising the steps of:

preparing an aqueous dispersion of a stabilizing and binding agent by mixing an aqueous polymer dispersion with a lubricant, with an aqueous paraffin dispersion and with a filler in the presence of usual additives;

blending said aqueous dispersion of said stabilizing and binding agent with a dry powerful explosive compound selected from the group consisting of cyclotetramethylenetetranitramine and cyclotrimethylenetrinitramine; and warm-drying the blend thus obtained to yield a high power explosive comprising at least 90 percent by weight of said powerful explosive compound and a maximum of 10 percent by weight of said stabilizing and binding agent.

2. Process as in claim 1 wherein the aqueous polymer dispersion is prepared from poly-O-alkyl acrylate or poly-O-alkyl methacrylate having an alkyl group comprising at least 3 carbon atoms in an amount in the range of about 18 to about 50 percent by weight of the solid stabilizing and binding agent.

3. Process as in claim 2 wherein the polymer is poly-O-butyl or poly-O-isobutyl acrylate.

4. Process as in claim 1 wherein the filler is an alkaline earth compound of low solubility.

5. Process as in claim 4 wherein the alkaline earth compound is selected from the group consisting of magnesium pyrophosphate, calcium carbonate, calcium sulphate, barium sulphate.

6. A process for preparing a high power explosive, said process comprising the steps of:

preparing an aqueous dispersion of a stabilizing and binding agent by mixing in the presence of usual additives an aqueous dispersion of a poly-O-alkyl acrylate or methacrylate containing in the range of about 20 to about 50 percent poly-O-alkyl acrylate by weight of the solid stabilizing and binding agent with an aqueous dispersion containing in the range of about 5 to about 15 percent poly ethylene by weight of said poly-O-alkyl acrylate, said poly ethylene having an average particle size in the range of about 0.1 to about 0.3 μm, and by adding a lubricant, an aqueous paraffin dispersion and a filler to the aqueous mixed polymer dispersion thus obtained;

blending said aqueous dispersion of said stabilizing and binding agent with a dry powerful explosive compound selected from the group consisting of cyclotetramethylenetetranitramine and cyclotrimethylenetrinitramine; and warm-drying the blend thus obtained to yield a high power explosive comprising at least 90 percent by weight of said powerful explosive compound and a maximum of 10 percent by weight of said stabilizing and binding agent.

7. Process as in claim 6 wherein the poly-O-alkyl acrylate or methacrylate has an alkyl group comprising at least 3 carbon atoms.

8. Process as in claim 7 wherein the poly-O-alkyl acrylate is poly-O-butyl acrylate or poly-O-isobutyl acrylate.

9. Process as in claim 8 wherein the lubricant is poly tetrafluoroethylene and in the range of about 2 to about 7 percent poly tetrafluoroethylene by weight of the solid stabilizing and binding agent are added in aqueous dispersion to the aqueous mixed polymer dispersion.

10. Process as in claim 9 wherein in the range of about 0.3 to about 1.5 percent microdispersed silica gel by weight of the solid stabilizing and binding agent are dispersed in the aqueous mixed polymer dispersion containing the lubricant.

11. Process as in claim 10 wherein an aqueous paraffin dispersion made up of in the range of about 10 to about 45 parts per weight of paraffin in about 55 to about 90 parts by weight of water is added at high stirring speed in an amount in the range of about 8 to about 20 percent by weight of the solid stabilizing and binding agent to the aqueous mixed polymer dispersion containing the lubricant and the silica gel.

12. Process as in claim 11 wherein the solid filler is added with continuous stirring and with increasing stirring speed to the aqueous mixed polymer dispersion containing the lubricant, the silica gel and the paraffin.

13. Process as in claim 12 wherein the filler is an alkaline earth compound of low solubility and is added in an amount in the range of about 20 to about 65 percent by weight of the solid stabilizing and binding agent.

14. Process as in claim 13 wherein the alkaline earth compound is selected from the group consisting of magnesium pyrophosphate, calcium carbonate, calcium sulphate, barium sulphate.

15. Process as in claim 14 wherein the filler is calcium carbonate having a particle size of approximately 1 μm.

16. Process as in claim 15 wherein 1 part by weight of the aqueous dispersion of the stabilizing and binding agent is blended with 10 parts by weight of the dry powerful explosive compound using a mixing drum, the blend is spread out in a thin layer and dried by a current of warm air with occasional turning over.

17. A process for preparing a high power explosive, said process comprising the steps of:

mixing in the presence of usual additives a first component containing a lubricant and a second component containing the filler of an aqueous dispersion of a stabilizing and binding agent;

admixing a third component of said aqueous dispersion of said stabilizing and binding agent to the mixture of the said two components;

blending said aqueous dispersion of said stabilizing and binding agent with a dry powerful explosive compound selected from the group consisting of cyclotetramethylenetetranitramine and cyclotrimethylenetrinitramine; and warm-drying the blend thus obtained to yield a high power explosive comprising at least 90 percent by weight of said powerful explosive compound and a maximum of 10 percent by weight of said stabilizing and binding agent.

18. Process as in claim 17 wherein the first component comprises an aqueous dispersion of a poly-O-alkyl acrylate or methacrylate having an alkyl group with at least 3 carbon atoms in which dispersion the lubricant and an aqueous dispersion made up of in the range of about 10 to about 45 parts by weight of paraffin and in the range of about 55 to about 90 parts by weight of water are dispersed consecutively with vigorous stirring and under the simultaneous action of ultrasound.

19. Process as in claim 18 wherein the poly-O-alkyl acrylate is poly-O-butyl acrylate or poly-O-isobutyl acrylate and the aqueous dispersion contains in the range of about 9 to about 21 percent of poly-O-butyl acrylate by weight of the solid stabilizing and binding agent, wherein the lubricant is graphite having an average particle size of about 2.5 μm and a particle size distribution of 95 percent below 0.5 μm and is added in an amount in the range of about 25 to about 65 percent by weight of said solid stabilizing and binding agent, and wherein about 0.5 percent paraffin by weight of said solid stabilizing and binding agent are added.

20. Process as in claim 19 wherein the second component of the aqueous dispersion of the stabilizing and binding agent comprises an aqueous dispersion of the filler in which microdispersed silica gel is dispersed with vigorous stirring under the simultaneous action of ultrasound followed by the addition of an aqueous dispersion made up of in the range of about 10 to about 45 parts by weight of paraffin and in the range of about 55 to about 90 parts by weight of water.

21. Process as in claim 20 wherein the filler is an alkaline earth compound of low solubility in the amount in the range of about 12 to about 25 percent by weight of the solid stabilizing and binding agent.

22. Process as in claim 21 wherein the alkaline earth compound is selected from the group consisting of magnesium pyrophosphate, calcium carbonate, calcium sulphate, barium sulphate.

23. Process as in claim 22 wherein the filler is calcium sulphate.

24. Process as in claim 23 wherein the first and the second component of the aqueous dispersion of the stabilizing and binding agent are mixed by kneading.

25. Process as in claim 17 wherein the third component of the aqueous dispersion of the stabilizing and binding agent comprises a dispersion of poly-O-butyl acrylate in an amount in the range of about 9 to about 20 percent by weight of the solid stabilizing and binding agent in an isopropanol-water mixture (mixing ratio 2 to 1).

26. Process as in claim 25 wherein cyclohexanone is added to the third component in an amount of about 7 percent by weight of the third component.

27. Process as in claim 26 wherein 1.5 parts by weight of the aqueous dispersion of the stabilizing and binding agent is blended with 10 parts by weight of the dry powerful explosive compound using a mixing drum, the blend is removed from the mixing drum and spread out in a thin layer and dried by a current of warm air with occasional turning over.

28. Process as in claim 26 wherein 1.5 parts by weight of the aqueous dispersion of the stabilizing and binding agent is blended with 10 parts by weight of the dry powerful explosive compound by turning over, the blend thus obtained is treated with an alkanol-water, preferably isopropanol-water, mixture in a mixing drum in an amount in the range of about 2 to about 10 percent by weight of the blend and the resulting mass is dried subsequently while being turned over.

29. Process as in claim 27 or claim 28 wherein the powerful explosive compound has a particle size of less than 1.68 mm, preferably less than 0.5 mm.

30. Process for preparing a high power explosive, said process comprising the steps of preparing in the presence of usual additives a first component of an aqueous dispersion of a stabilizing and binding agent by dispersing about 6 parts by weight of an aqueous dispersion containing about 24 percent by weight of poly-O-butyl acrylate, and about 5 parts by weight of graphite in about 9.7 parts by weight of water under the action of ultrasound and mixing the dispersion thus obtained with about 0.8 parts by weight of an aqueous dispersion containing about 24 percent by weight of paraffin, preparing in the presence of usual additives a second component of said aqueous dispersion of said stabilizing and binding agent by dispersing about 2 parts by weight of calcium sulphate and about 0.16 parts by weight of silica gel under the action of ultrasound in about 6.7 parts by weight of water and by adding to the dispersion thus obtained about 5.35 parts by weight of the aqueous dispersion containing about 24 percent by weight of paraffin, mixing 3 parts by weight of said first and 2 parts by weight of said second component at 35° C., mixing in the presence of usual additives about 10 parts by weight of the mixture thus obtained with a third component of said aqueous dispersion of said stabilizing and binding agent, said third component comprising about 0.9 parts by weight of a dispersion containing poly-O-butyl acrylate and a 2 to 1 isopropanol-water mixture in a 2 to 3 ratio, blending the aqueous dispersion of said stabilizing and binding agent with dry cyclotetramethylenetetranitramine and warm-drying the blend thus obtained to yield a high power explosive comprising at least 90 percent by weight of cyclotetramethylenetetranitramine and a maximum of 10 percent by weight of said stabilizing and binding agent.

31. Process as in claim 30 wherein cyclohexanone is added to the third component in an amount of about 7 percent by weight of the third component.

32. Process as in claim 30 or 31 wherein 1.5 parts by weight of the aqueous dispersion of the stabilizing and binding agent is blended with 10 parts by weight of cyclotetramethylenetetranitramine using a mixing drum, the blend is removed from the mixing drum and spread out in a thin layer and dried by a current of warm air with occasional turning over.

33. Process as in claim 30 or 31 wherein 1.5 parts by weight of the aqueous dispersion of the stabilizing and binding agent is blended with 10 parts by weight of cyclotetramethylenetetranitramine by turning over, the blend thus obtained is treated with an alkanol-water, preferably isopropanol-water, mixture in a mixing drum in an amount in the range of about 2 to about 10 percent by weight of the blend and the resulting mass is dried subsequently while being turned over.

34. Process as in claim 30 wherein cyclotetramethylenetetranitramine has a particle size of less than 1.68 mm, preferably less than 0.5 mm.

35. Plastic bound high power explosive comprising at least 90 percent by weight of a powerful explosive compound selected from the group consisting of cyclotetramethylenetetranitramine and cyclotrimethylenetrinitramine and a maximum of 10 percent of a stabilizing and binding agent substantially composed of an acrylate or methacrylate polymer, of a lubricant, of a filler and of wax or paraffin.

36. High power explosive as in claim 35 wherein the polymer is a poly-O-alkyl acrylate having an alkyl group comprising at least 3 carbon atoms and wherein the stabilizing and binding agent comprises in the range of about 18 to about 50 percent by weight of the poly-O-alkyl acrylate.

37. High power explosive as in claim 36 wherein the poly-O-alkyl acrylate is poly-O-butyl acrylate or poly-O-isobutyl acrylate.

38. High power explosive as in anyone of claims 35 to 37 wherein the lubricant is selected from the group consisting of poly tetrafluoroethylene, graphite.

39. High power explosive as in claim 38 wherein the filler is an alkaline earth compound of low solubility in water.

40. High power explosive as in claim 39 wherein the filler is selected from the group consisting of magnesium pyrophosphate, calcium carbonate, calcium sulphate, barium sulphate.

41. High power explosive as in claim 35 wherein the stabilizing and binding agent comprises additionally in the range of about 0.3 to about 2.3 percent by weight of microdispersed silica gel.

42. Plastic bound high power explosive containing at least 90 percent by weight of a powerful explosive compound selected from the group consisting of cyclotetramethylenetetranitramine and cyclotrimethylenetrinitramine and a maximum of 10 percent by weight of a stabilizing and binding agent substantially comprising in the range of about 20 to about 50 percent by weight of a poly-O-alkyl acrylate having an alkyl group with at least 3 carbon atoms and in the range of about 5 to about 15 percent poly ethylene by weight of said poly-O-alkyl acrylate, the polyethylene having an average particle size in the range of about 0.1 to about 0.3 μm;

comprising further poly tetrafluoroethylene as a lubricant in the range of about 2 to about 7 percent by weight;

comprising in the range of about 20 to about 65 percent by weight of an alkaline earth compound of low water solubility as a filler; and comprising in the range of about 8 to about 20 percent by weight of paraffin.

43. High power explosive as in claim 42 wherein the poly-O-alkyl acrylate is poly-O-butyl acrylate or poly-O-isobutyl acrylate.

44. High power explosive as in claim 42 wherein the alkaline earth compound is selected from the group consisting of magnesium pyrophosphate, calcium carbonate, calcium sulphate, barium sulphate.

45. High power explosive as in claim 44 wherein the alkaline earth compound is calcium carbonate having a particle size of about 1 μm.

46. High power explosive as in claim 45 wherein the stabilizing and binding agent comprises additionally in the range of about 0.3 to about 1.5 percent by weight of microdispersed silica gel.

47. Plastic bound high power explosive containing at least 90 percent by weight of a powerful explosive compound selected from the group consisting of cyclotetramethylenetetranitramine and cyclotrimethylenetrinitramine and a maximum of 10 percent by weight of a stabilizing and binding agent substantially comprising in the range of about 18 to about 40 percent by weight of a poly-O-alkyl acrylate having an alkyl group with at least 3 carbon atoms;

comprising further in the range of about 25 to about 65 percent by weight of graphite as a lubricant;

comprising in the range of about 12 to about 25 percent by weight of an alkaline earth compound of low water solubility as a filler; and comprising in the range of about 7 to about 17 percent by weight of paraffin.

48. High power explosive as in claim 47 wherein the powerful explosive compound comprises about 90 to about 97 percent by weight of the explosive and has a particle size of below 1.68 mm, preferably below 0.5 mm.

49. High power explosive as in claim 48 wherein the poly-O-alkyl acrylate is poly-O-butyl acrylate or poly-O-isobutyl acrylate.

50. High power explosive as in claim 49 wherein the graphite has an average particle size of about 2.5 μm and a particle size distribution of 95 percent below 0.5 μm.

51. High power explosive as in claim 50 wherein the alkaline earth compound is selected from the group consisting of magnesium pyrophosphate, calcium carbonate, calcium sulphate, barium sulphate.

52. High power explosive as in claim 51 wherein the alkaline earth compound is calcium sulphate.

53. High power explosive as in claim 47 wherein the stabilizing and binding agent comprises additionally in the range of about 0.3 to about 2.3 percent by weight of microdispersed silica gel.

54. Method for shaping by compressing a high power explosive comprising at least 90 percent by weight of a powerful explosive compound selected from the group consisting of cyclotetramethylenetetranitramine and cyclotrimethylenetrinitramine and a maximum of 10 percent by weight of a stabilizing and binding agent, said stabilizing and binding agent substantially comprising an acrylate or methacrylate polymer, a lubricant selected from the group consisting of poly tetrafluoroethylene and graphite, an alkaline earth compound of low water solubility as a filler, wax or paraffin and microdispersed silica gel, in which method said high power explosive is filled into a mold and compressed using a die at pressures in excess of 1.5 kbar at ambient temperature.

55. Method as in claim 54 in which pressures in the range of about 1.5 to about 4.2 kbar are applied during compression.

* * * * *